US008723749B2

(12) United States Patent
Lin et al.

(10) Patent No.: US 8,723,749 B2
(45) Date of Patent: May 13, 2014

(54) RADIO-FREQUENCY DEVICE AND WIRELESS COMMUNICATION DEVICE

(75) Inventors: Hsiao-Yi Lin, Hsinchu (TW); Jhih-Yuan Ke, Hsinchu (TW); Chih-Ming Wang, Hsinchu (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 324 days.

(21) Appl. No.: 13/350,842

(22) Filed: Jan. 16, 2012

(65) Prior Publication Data

US 2013/0127677 A1 May 23, 2013

(30) Foreign Application Priority Data

Nov. 17, 2011 (TW) ..... 100142160 A
Dec. 20, 2011 (TW) ..... 100147446 A

(51) Int. Cl.
*H01Q 13/00* (2006.01)

(52) U.S. Cl.
USPC ..... 343/772

(58) Field of Classification Search
CPC ..... H01Q 13/20; H01Q 13/06; H01Q 13/28
USPC ..... 343/772, 702, 700 MS, 725, 728, 846, 343/848
See application file for complete search history.

(56) References Cited

U.S. PATENT DOCUMENTS

| | | | | |
|---|---|---|---|---|
| 7,324,054 | B2 * | 1/2008 | Ozkar | 343/702 |
| 7,663,556 | B2 * | 2/2010 | Desclos et al. | 343/702 |
| 7,868,838 | B2 * | 1/2011 | Tai | 343/729 |
| 8,111,195 | B2 * | 2/2012 | Hung et al. | 343/700 MS |
| 8,134,517 | B2 * | 3/2012 | Wang et al. | 343/846 |
| 8,618,990 | B2 * | 12/2013 | Somero | 343/702 |

* cited by examiner

*Primary Examiner* — Huedung Mancuso
(74) *Attorney, Agent, or Firm* — Wintson Hsu; Scott Margo

(57) ABSTRACT

The present invention discloses an RF device for a wireless communication device, including a grounding element, an antenna, including a radiating element, a feed-in element, a coupling element, a switch, coupled between the coupling element and the grounding element, for connecting or disconnecting the grounding element to the coupling element, such that the antenna respectively operates in a first frequency band and a second frequency band, and a grounding terminal, for coupling the grounding element, a capacitive sensing element, for sensing an environment capacitance within a specific range through the radiating element, at least one capacitor, for blocking a DC route from the grounding terminal to the grounding element.

16 Claims, 5 Drawing Sheets

RADIO-FREQUENCY DEVICE AND WIRELESS COMMUNICATION DEVICE

BACKGROUND OF THE INVENTION

1. Field of the Invention

The present invention relates to a radio-frequency device and wireless communication device, and more specifically, to a radio-frequency device and wireless communication device capable of automatically adjusting output power and radiating frequency.

2. Description of the Prior Art

A wireless communication device exchanges radio-frequency signals through an antenna to access information within a wireless communication system. A radio-frequency (RF) signal is a sinusoidal wave with a high oscillating frequency, and governments in the world have defined safety limits, e.g. by electromagnetic standards, for exposure to RF energy produced from wireless communication devices, which mainly exposes to human head or limb. The electromagnetic standards as to the RF energy exposure are based on SAR (specific absorption rate) instead of on the ration of maximum/minimum output power. SAR is a measure of the rate at which energy is absorbed by a human body when exposed to an RF electromagnetic field. According to ICNIRP (International Commission on Non-Ionizing Radiation Protection), a recommended SAR value should not exceed 2.0 W/Kg. According to FCC (Federal Communications Commission), the recommended SAR value should not exceed 1.6 W/Kg.

However, as well known to those skilled in the art, the greater antenna gain, the worse SAR value; the smaller antenna size, the narrower radiating bandwidth. A traditional method for reaching good SAR value is to dispose proximity sensor beside the antenna for detecting approaching status of the human body. In other words, when the proximity sensor detects the human body within a specific range, the wireless communication device decreases the power of the RF signal; once the human body is not detected within the specific range, the power of the RF signal is maintained or increased.

On the other hand, due to a trend of light and compact wireless communication device and growing wireless communication demands, an ideal antenna inside the wireless communication device should be small, antenna gain thereof should be high and radiating bandwidth thereof should be as wider as possible. However, as well known in the art, the antenna requires a longer current route to induce the RF signal with lower frequency. Besides, to reach multiple radiating frequency bands in the lower frequency requires much larger antenna space. To meet these requirements, additional antennas may be required for operating in another frequency band.

As a result, the additional proximity sensors and antennas for covering other frequency bands both increase design and production cost and increase complexity of the material or part management. Thus, how to solve the tradeoff between SAR and antenna performance and the tradeoff between antenna size and radiating band width have become a goal in the wireless communication industry.

SUMMARY OF THE INVENTION

It is therefore an object of the present invention to provide an RF device and related wireless communication device capable of automatically adjusting output power and radiating frequency.

The present invention discloses an RF device for a wireless communication device, including a grounding element, for providing grounding, an antenna, including a radiating element, a feed-in element, coupled to the radiating element, for transmitting an RF signal through the radiating element, a coupling element, for coupling the radiating element, a switch, coupled between the coupling element and the grounding element, for connecting or disconnecting the grounding element to the coupling element, such that the antenna respectively operates in a first frequency band and a second frequency band, and a grounding terminal, for coupling the grounding element, a capacitive sensing element, electrically connected to the radiating element of the antenna, for sensing an environment capacitance within a specific range through the radiating element, at least one capacitor, electrically connected between the grounding terminal and the grounding element, for blocking a DC route from the grounding terminal to the grounding element.

The present invention further discloses a wireless communication device, including an RF signal processing device, for generating an RF signal, adjusting a power of the RF signal according to a sensing result, and adjusting an operating frequency band according to the RF signal, and an RF device, including a grounding element, for providing grounding, an antenna, including a radiating element, a feed-in element, coupled to the radiating element, for transmitting an RF signal through the radiating element, a coupling element, for coupling the radiating element, a switch, coupled between the coupling element and the grounding element, for connecting or disconnecting the grounding element to the coupling element, such that the antenna respectively operates in a first frequency band and a second frequency band, and a grounding terminal, for coupling the grounding element, a capacitive sensing element, electrically connected to the radiating element of the antenna, for sensing an environment capacitance within a specific range through the radiating element, at least one capacitor, electrically connected between the grounding terminal and the grounding element, for blocking a DC route from the grounding terminal to the grounding element.

The present invention further discloses an RF device for a wireless communication device, including a grounding element, for providing grounding, an antenna, including a radiating element, including a long side and a plurality of short sides, for transmitting an RF signal, a coupling element, for coupling an RF signal, a feed-in element, coupled to the coupling element, for transmitting the RF signal to the radiating element through the coupling element, and a switch, coupled between the plurality of short sides and the grounding element, for switching one of the plurality of short sides to connect with the grounding element, such that the antenna respectively operates in a first frequency band and a second frequency band, and a capacitive sensing element, electrically connected to the radiating element of the antenna, for sensing an environment capacitance within a specific range through the radiating element.

The present invention further discloses a wireless communication device, including an RF signal processing device, for generating an RF signal, adjusting a power of the RF signal according to a sensing result, and adjusting an operating frequency band according to the RF signal, and an RF device, including a grounding element, for providing grounding, an antenna, including a coupling element, for coupling an RF signal, a feed-in element, coupled to the coupling element, for transmitting the RF signal through the coupling element, a radiating element, including a long side and a plurality of short sides, for transmitting the RF signal from the coupling element, and a switch, coupled between the plurality of short sides and the grounding element, for switching one of the plurality of short sides to connect with the grounding element, such that the antenna respectively operates in a first frequency band and a second frequency band, a capacitive sensing element, electrically connected to the radiating element of the antenna, for sensing an environment capacitance within a specific range through the radiating element.

These and other objectives of the present invention will no doubt become obvious to those of ordinary skill in the art after reading the following detailed description of the preferred embodiment that is illustrated in the various figures and drawings.

DETAILED DESCRIPTION

In order to maintain antenna performance and have enough radiating bandwidth, the present invention utilizes a radiator of an antenna as a sensor to detect an approaching status of an object, e.g. human body, to monitor whether an environment capacitance stays within a specific range, and accordingly adjust an output power of a wireless signal. Furthermore, the present invention distinguishes an operating frequency according to the received wireless signal to adjust a radiating frequency band of the antenna. In comparison, the conventional method requires additional proximity sensors to detect the approaching status of the object, which causes extra cost and influence on antenna performance and narrows the bandwidth of the antenna. The following description illustrates two antenna types for realizing the present invention.

Figure 1:
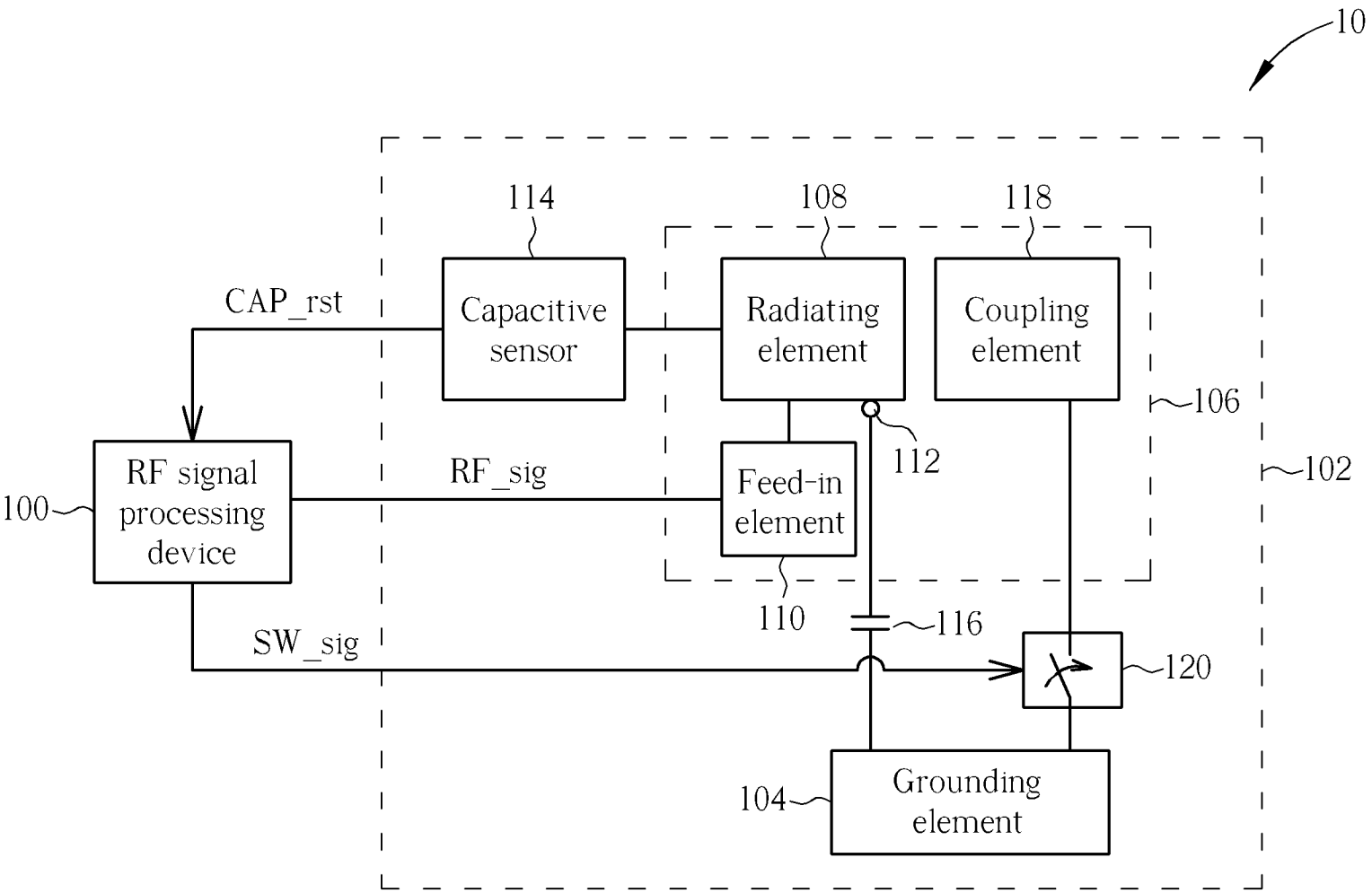
FIG. 1 is a schematic diagram of a wireless communication device according to an embodiment of the present invention.

For an antenna that directly feeds a radio-frequency (RF) signal into the radiator, please refer to FIG. 1, which is a schematic diagram of a wireless communication device 10 according to an embodiment of the present invention. The wireless communication device 10 may be any electronic products with wireless function, such as a mobile phone, computer system, wireless access point, etc. The wireless communication device 10 is simply composed of an RF signal processing device 100 and an RF device 102. The RF signal processing device 100 is used for processing an RF signal RF_sig transmitted and received by the RF device 102, adjusting a power of the RF signal RF_sig according to a sensing result CAP_rst of an environment capacitance measured by the RF device 102, and adjusting an operating frequency band of the RF device 102 according to a carrier frequency of the received RF signal RF_sig.

In detail, the RF device 102 includes a grounding element 104, a tunable antenna 106, a capacitive sensor 114, a capacitor 116 and a switch 120. The tunable antenna 106 is used for transmitting and receiving the RF signal RF_sig, and includes a radiating element 108, a feed-in element 110, a grounding terminal 112 and a coupling element 118. The capacitive sensor 114 is coupled to the radiating element 108, for measuring and determining whether the environment capacitance stays within a specific range through the radiating element 108, to generate the sensing result CAP_rst accordingly. Then, the RF signal processing device 100 adjusts the power of the RF signal RF_sig according to the received sensing result CAP_rst. The capacitor 116 is disposed between the grounding terminal 112 and the grounding element 104, for blocking a direct-current (DC) route between the grounding terminal 112 and the grounding element 104, which avoids the capacitive sensor 114 measures the environment capacitance induced from the grounding element 104. The coupling element 118 is used for generating a coupling effect between radiating element 108 and the coupling element 118. The switch 120 is coupled between the coupling element 118 and the grounding element 104, for switching the coupling element 118 to connect or disconnect with the grounding element 104 to change the coupling effect between radiating element 108 and the coupling element 118, such that the operating frequency of the tunable antenna 106 is changed.

Specifically, in the wireless communication device 10, the capacitive sensor 114 utilizes the radiating element 108 of the tunable antenna 106 to measure the environment capacitance, and transmits the sensing result CAP_rst to the RF signal processing device 100, such that the RF signal processing device 100 adjusts the power of the RF signal RF_sig accordingly. Without the capacitor 116, the radiating element 108 is electrically connected to the grounding element 104, which causes the DC route exists between the radiating element 108 and the grounding element 104. In order to avoid such a situation, the RF device 102 utilizes the capacitor 116 to block the DC route between the grounding terminal 112 and the grounding element 104, such that the capacitive sensor 114 measures the environment capacitance only through the radiating element 108. On the other hand, the RF signal processing device 100 determines whether the current operating frequency of the wireless communication device 10 is appropriate according to the carrier frequency of the RF signal RF_sig, and the RF signal processing device 100 transmits a switch signal SW_sig to the switch 120 to connector disconnect the coupling element 118 with the grounding element 104, so as to adjust the operating frequency of the tunable antenna 106 and meet an operating frequency of a local base station.

Figure 2:
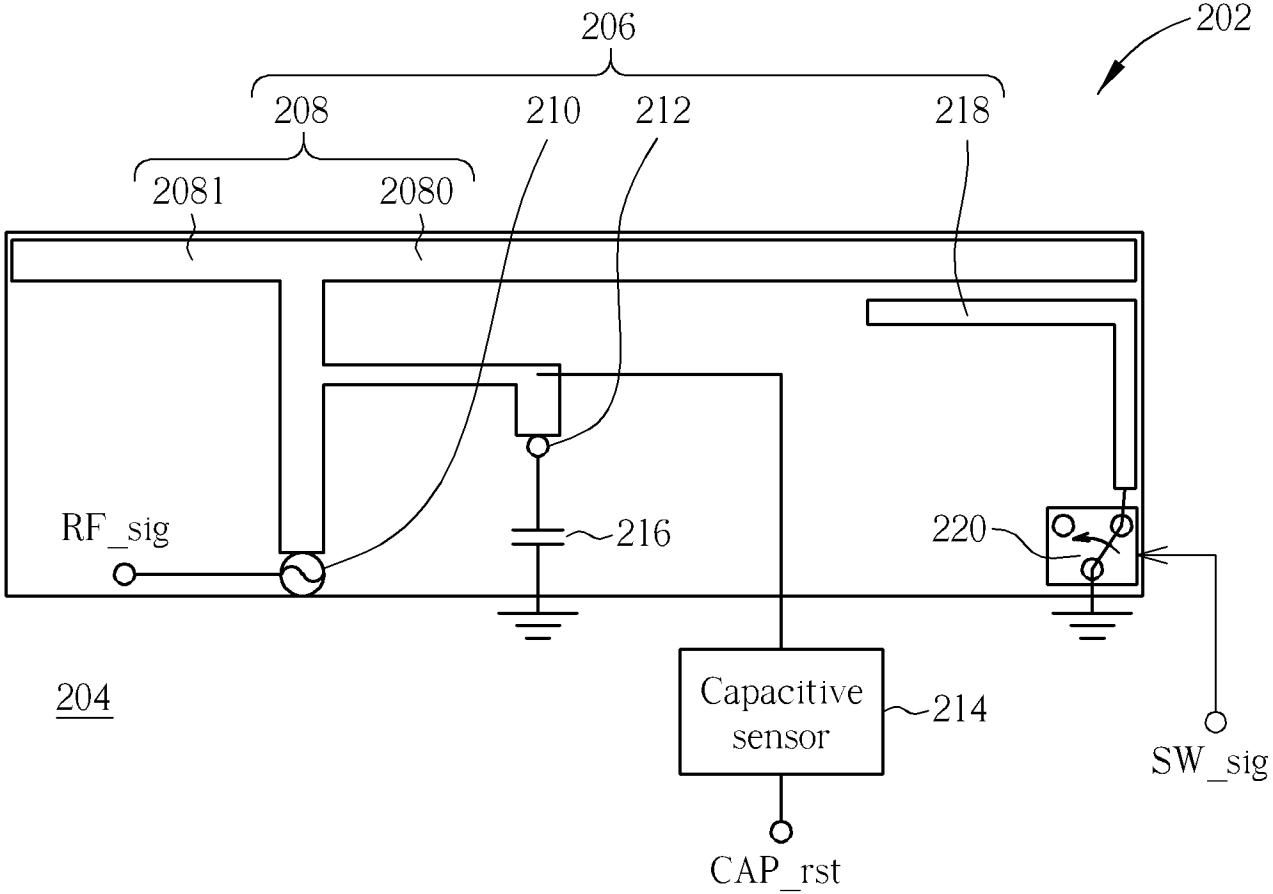
FIG. 2 is a schematic diagram of an RF device according to an embodiment of the present invention.

For example, please refer to FIG. 2, which is a schematic diagram of an RF device 202 according to an embodiment of the present invention. The RF device 202 includes a grounding element 204, a capacitive sensing element 214, a capacitor 216 and a switch 220, wherein the tunable antenna 206 includes a radiating element 208, a feed-in element 210, a grounding terminal 212 and a coupling element 218. As shown in FIG. 2, the capacitive sensor 214 is electrically connect to the radiating element 208 for measuring the environment capacitance through the radiating element 208, and the capacitor 216 is electrically connected between the grounding terminal 212 and the grounding element 204 to block the DC route between the grounding terminal 212 and the grounding element 204, such that the capacitive sensor 214 measures the environment capacitance only through the radiating element 208. The tunable antenna 206 is a dual-band antenna, and the radiating element 208 may be composed of a long side 2080 and a short side 2081, for respectively transmitting and receiving the RF signal RF_sig corresponding to a low frequency and a high frequency.

In practice, telecommunication operators in different areas or countries utilize different wireless communication techniques or operating frequency bands. The following table is an example showing practical operating frequency bands among different areas.

| Global System for Mobile Communications (GSM) | Frequency Range (MHz) | Area/Country |
|---|---|---|
| 800 | 824-894 | USA |
| 1900 | 1850-1990 | |
| 900 | 880-960 | Europe |
| 1800 | 1710-1880 | |

To meet the practical requirement, the tunable antenna 206 utilizes the short side 2081 to receive the RF signal RF_sig with high frequency, i.e. 1800 MHz or 1900 MHz, transmitted from the local base station, such that the RF signal processing device 100 determines the frequency band of the local base station according to the carrier frequency of the RF signal RF_sig. In such a situation, the coupling element 118 is close to the long side 2080 to generate the coupling effect with the long side 2080, to adjust the low operating frequency, i.e. 800 MHz or 900 MHz, of the tunable antenna 206. When the RF signal processing device 100 determines the current operating frequency band is 1900 MHz, the RF signal processing device 100 controls the switch 220 to connect the coupling element 118 with the grounding element 204, such that an equivalent current route on the long side 2080 is extended to shift the low operating frequency to 800 MHz. When the RF signal processing device 100 determines the current operating frequency is 1800 MHz, the RF signal processing device 100 controls the switch 220 to disconnect the coupling element 118 with the grounding element 204, such that the equivalent current route on the long side 2080 is shortened, and the operating frequency is shifted from 800 MHz to 900 MHz. As a result, the wireless communication device 10 can work indifferent areas or countries by automatically detecting the operating frequency bands of the local base station and adjusting the operating frequency of the tunable antenna 206 accordingly.

According to above description, the wireless communication device 10 achieves RF power management by utilizing the radiating element 108 to measure the environment capacitance, which ensures SAR value stays within the recommended standard. In contrast to traditional method of adding the proximity sensors beside the antenna to detect approaching objects (i.e. human body), the present invention can save the production cost and mitigate the influence on the antenna performance due to the near proximity sensor, and material or parts management of the RF device 102 can be easier as well. Meanwhile, the wireless communication device 10 also achieves operating frequency adjustment by recognizing the carrier frequency of the RF signal RF_sig to distinguish the operating frequency of the local base station, so as to utilize the limited bandwidth effectively. Those skilled in the art could make modifications or alterations accordingly, which are not limited.

For instance, as shown in FIG. 2, the capacitive sensing element 214 and the feed-in element 210 are not limited to sharing a same node, as long as the capacitive sensing element 214 is electrically connected to the radiating element 208. Antenna type of the antenna 106 is not limited to PIFA (Planar Inverted F Antenna), which could be a slot, dipole, folded dipole antenna as well. The manner of connecting the capacitive sensing element 214 with the radiating element 208 and detailed realization of the present invention with different antenna types can refer to TW patent application No. 100142160. Besides, the coupling effect between the coupling element 218 and the radiating element 208 is not limited to two switching states, i.e. connect or disconnect the coupling element 218 with the grounding element 204, and there may be multiple switching states to have different frequency shifting results and better design flexibility. Detailed description and embodiments may refer to TW patent application No. 100147446.

Figure 3:
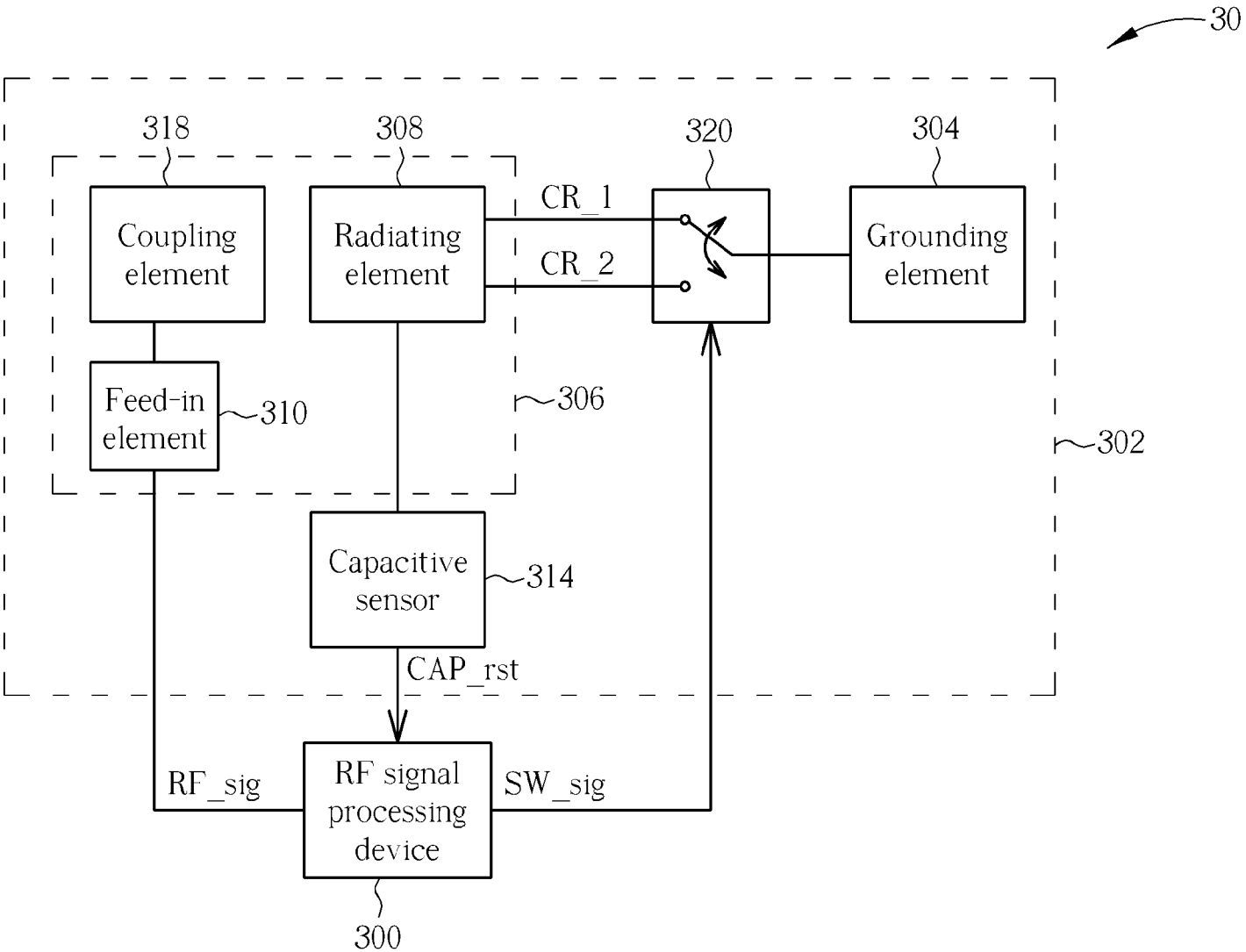
FIG. 3 is a schematic diagram of a wireless communication device according to an embodiment of the present invention.

The following description illustrates the antenna that feeds RF signal into a coupling element. Please refer to FIG. 3, which is a schematic diagram of a wireless communication device 30 according to an embodiment of the present invention. The wireless communication device 30 may be any electronic products with wireless function, such as a mobile phone, computer system, wireless access point, etc. The wireless communication device 30 is simply composed of an RF signal processing device 300 and an RF device 302. The RF signal processing device 300 is used for processing an RF signal RF_sig transmitted and received by the RF device 302, adjusting the power of the RF signal RF_sig according to the sensing result CAP_rst of the environment capacitance measured by the RF device 302, and adjusting the operating frequency band of the RF device 302 according to a carrier frequency of the received RF signal RF_sig.

In detail, the RF device 302 includes a grounding element 304, a tunable antenna 306, a capacitive sensor 314 and a switch 320. The tunable antenna 306 is used for transmitting and receiving the RF signal RF_sig, and includes a radiating element 308, a feed-in element 310 and a coupling element 318. The capacitive sensor 314 is coupled to the radiating element 308, for measuring and determining whether the environment capacitance stays within the specific range through the radiating element 308, to generate the sensing result CAP_rst accordingly. Then, the RF signal processing device 300 adjusts the power of the RF signal RF_sig according to the received sensing result CAP_rst. The coupling element 318 is electrically connected to the feed-in element 310, for coupling the RF signal RF_sig to the radiating element 308. The switch 320 is coupled between the radiating element 308 and the grounding element 304, for switching one of current routes CR_1 and CR_2 on the radiating element 308 to connect with the grounding element 304, such that the operating frequency of the tunable antenna 306 is changed.

In short, in the wireless communication device 30, the capacitive sensor 314 utilizes the radiating element 308 of the tunable antenna 306 to measure the environment capacitance, and transmits the sensing result CAP_rst to the RF signal processing device 300, such that the RF signal processing device 300 adjusts the power of the RF signal RF_sig accordingly. On the other hand, the RF signal processing device 300 determines whether the current operating frequency of the wireless communication device 30 is appropriate according to the carrier frequency of the RF signal RF_sig, and the RF signal processing device 300 transmits a switch signal SW_sig to the switch 120 to connect one of the current routes CR_1 and CR_2 with the grounding element 304, so as to adjust the operating frequency of the tunable antenna 306 and meet an operating frequency of a local base station.

Figure 4:
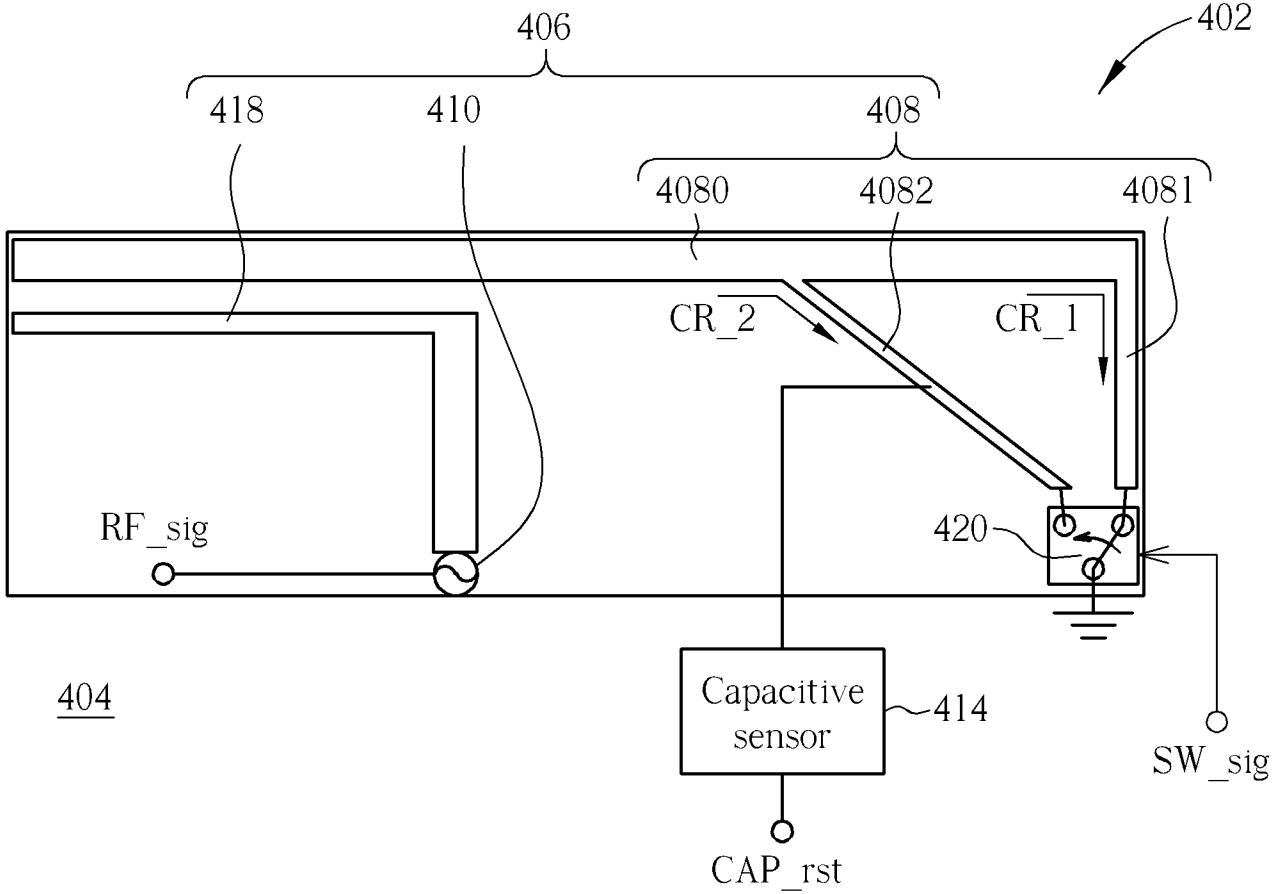
FIG. 4 is a schematic diagram of an RF device according to an embodiment of the present invention.

For example, please refer to FIG. 4, which is a schematic diagram of an RF device 402 according to an embodiment of the present invention. The RF device 402 includes a grounding element 404, a capacitive sensing element 414 and a switch 420, wherein the tunable antenna 406 includes a radiating element 408, a feed-in element 410 and a coupling element 418. As shown in FIG. 4, the feed-in element 410 of the tunable antenna 406 is electrically connected to the coupling element 418, for coupling the RF signal RF_sig to the radiating element 408. The switch 420 is coupled between the radiating element 408 and the grounding element 404, wherein the radiating element 408 is composed of a long side 4080 and short sides 4081 and 4082. The switch 420 is used for switching the short side 4081 or 4082 to connect with the grounding element 404 to generate the current route CR_1 or CR_2 on the radiating element 408. With a similar manner as the RF device 202, the RF device 402 utilizes the tunable antenna 406 to receive the RF signal RF_sig with high frequency, i.e. 1800 MHz or 1900 MHz, transmitted from the local base station, such that the RF signal processing device 300 determines the frequency band of the local base station according to the carrier frequency of the RF signal RF_sig, so as to adjust the low operating frequency of the RF signal RF_sig accordingly. The current route CR_1 is longer than the current route CR_2, when the RF signal processing device 300 determines the current operating frequency is 1900 MHz, the RF signal processing device 300 controls the switch 420 to connect the short side 4081 with the grounding element 404 to shift the low operating frequency to 800 MHz. When the RF signal processing device 300 determines the current operating frequency is 1800 MHz, the RF signal processing device 300 controls the switch 420 to connect the short side 4082 with the grounding element 404, such that the low operating frequency is shifted to from 800 MHz to 900 MHz. As a result, the wireless communication device 30 can work in different areas or countries by automatically detecting the operating frequency bands of the local base station and adjusting the operating frequency of the tunable antenna 406 accordingly.

Figure 5:
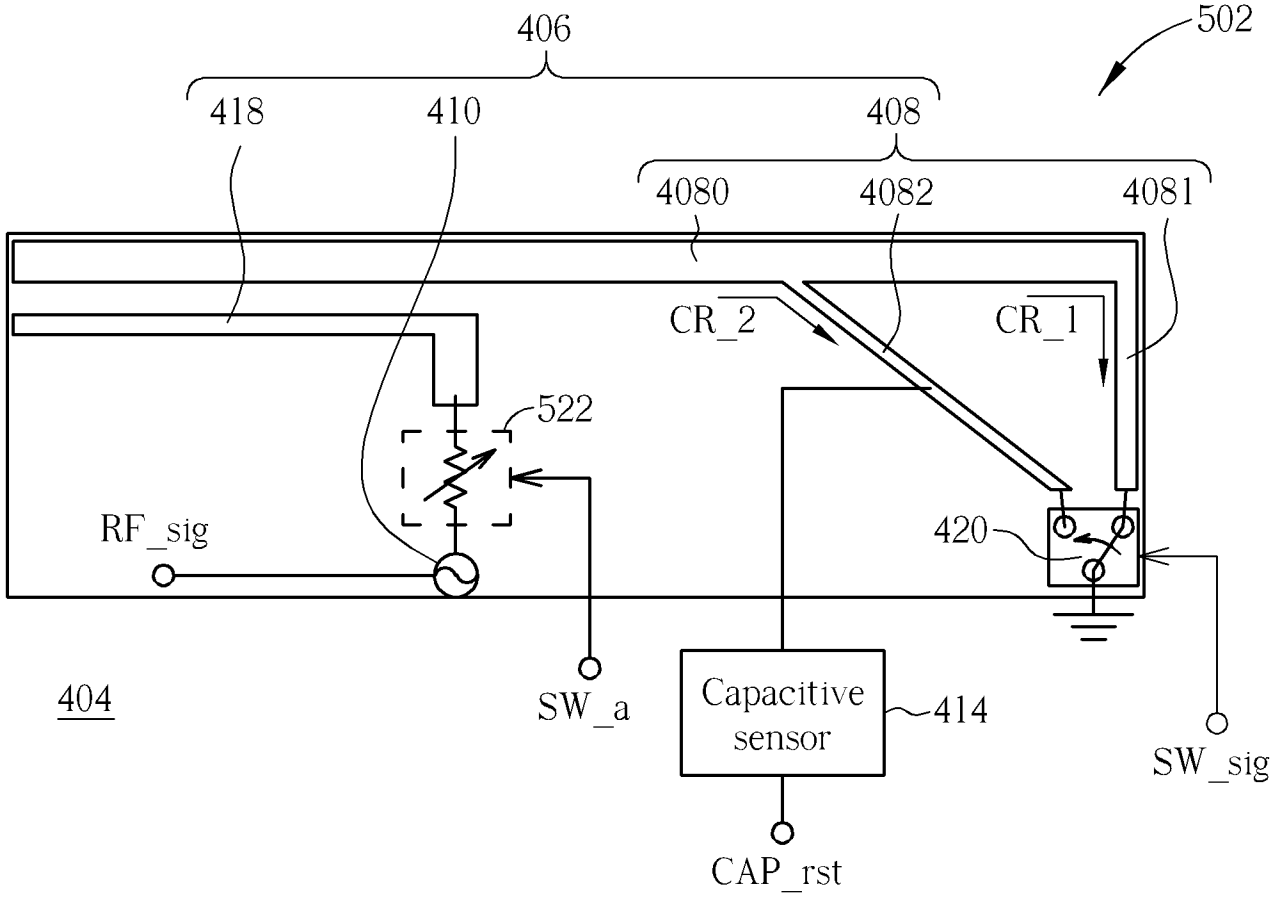
FIG. 5 is a schematic diagram of an RF device according to an embodiment of the present invention.

Moreover, an attenuator for adjusting the power of the RF signal RF_sig may be further included in the RF device 402. Please refer to FIG. 5, which is a schematic diagram of an RF device 502 according to an embodiment of the present invention. The RF device 502 is similar to the RF device 402, and thus same elements are denoted with the same symbols. As shown in FIG. 5, an attenuator 522 is coupled between the coupling element 418 and the feed-in element 410. The RF signal processing device 300 may further send a control signal SW_a to control the attenuator 522 for adjusting the power of the RF signal RF_sig according to the sensing result CAP_rst. For example, when the capacitive sensor 414 detects the approaching of human body and sends the sensing result CAP_rst to lower the power of the RF signal, the RF signal processing device 300 sends the control signal SW_a to the attenuator 522 to attenuate the power of the RF signal, e.g. increase input resistance of the coupling element 418. After the human body has left, the RF signal processing device sends the control signal SW_a to the attenuator 522 to return to zero attenuation to the RF signal, e.g. short the coupling element 418 with the feed-in element 410.

According to above description, the wireless communication device 30 achieves RF power management by utilizing the radiating element 308 to measure the environment capacitance, which ensures SAR value stays within the recommended standard. In contrast to traditional method of adding the proximity sensors beside the antenna to detect approaching objects (i.e. human body), the present invention may save the production cost and mitigate the influence on the antenna performance due to the near proximity sensor, and material or parts management of the RF device 102 can be easier as well. Meanwhile, the wireless communication device 30 achieves operating frequency adjustment by recognizing the carrier frequency of the RF signal RF_sig to distinguish the operating frequency of the local base station, so as to reach enough antenna bandwidth within a limited antenna space. Those skilled in the art could make modifications or alterations accordingly, which are not limited.

For instance, the capacitive sensing element 414 and the feed-in element 410 are not limited to sharing a same node, as long as the capacitive sensing element 414 is electrically connected to the radiating element 408. Operations of the RF signal processing element 300, the capacitive sensor 314 and the manner of connecting the capacitive sensing elements 314 and 414 with the radiating elements 308 and 408 are not limited, which can refer to TW patent application No. 100142160. Besides, the current routes on the radiating element 408 is not limited to current routes CR_1 and CR_2, and there may be multiple current routes for selection to have different frequency shifting results and better design flexibility. Detailed description and embodiments may refer to TW patent application No. 100147446.

To sum up, in contrast to traditional method that requires additional proximity sensors to detect the approaching status of the object, which causes extra cost and influence on antenna performance, the present invention utilizes the radiator of the antenna as the sensor to detect the approaching of human body, to monitor whether an environment capacitance stays within a specific range, and accordingly adjust an output power of a wireless signal. Meanwhile, the RF signal processing device distinguishes the operating frequency according the received wireless signal to adjust a radiating frequency band of the antenna. As a result, the present invention achieves automatically adjusting output power and radiating frequency at the same time.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A radio-frequency (RF) device for a wireless communication device, comprising:
- a grounding element, for providing grounding;
- an antenna, comprising:
  - a radiating element;
  - a feed-in element, coupled to the radiating element, for transmitting an RF signal through the radiating element;
  - a coupling element, for coupling the radiating element;
  - a switch, coupled between the coupling element and the grounding element, for connecting or disconnecting the grounding element to the coupling element, such that the antenna respectively operates in a first frequency band and a second frequency band; and
  - a grounding terminal, for coupling the grounding element;
- a capacitive sensing element, electrically connected to the radiating element of the antenna, for sensing an environment capacitance within a specific range through the radiating element;
- at least one capacitor, electrically connected between the grounding terminal and the grounding element, for blocking a direct-current (DC) route from the grounding terminal to the grounding element.

2. The RF device of claim 1, wherein the capacitive sensing element is further used for transmitting a sensing result of the environment capacitance to an RF signal processing device of the RF device, so as to adjust a power of the RF signal through the RF signal processing device.

3. The RF device of claim 1, wherein the coupling element of the antenna further comprises:
- a horizontal side;
- at least one vertical side, electrically connected to the horizontal side, for generating different coupling effects between the coupling element and the radiating element via switching one of the vertical side to connect with the grounding element.

4. The RF device of claim 1, wherein the switch connects and disconnects the coupling element of the antenna respectively generate a first coupling effect and a second coupling effect on the radiating element, wherein the first and the second current routes correspond to the first and the second frequency bands.

5. A wireless communication device, comprising:

a radio-frequency (RF) signal processing device, for generating an RF signal, adjusting a power of the RF signal according to a sensing result, and adjusting an operating frequency band according to the RF signal; and an RF device, comprising:

a grounding element, for providing grounding;

an antenna, comprising:

a radiating element;

a feed-in element, coupled to the radiating element, for transmitting an RF signal through the radiating element;

a coupling element, for coupling the radiating element;

a switch, coupled between the coupling element and the grounding element, for connecting or disconnecting the grounding element to the coupling element, such that the antenna respectively operates in a first frequency band and a second frequency band; and a grounding terminal, for coupling the grounding element;

a capacitive sensing element, electrically connected to the radiating element of the antenna, for sensing an environment capacitance within a specific range through the radiating element;

at least one capacitor, electrically connected between the grounding terminal and the grounding element, for blocking a direct-current (DC) route from the grounding terminal to the grounding element.

6. The RF device of claim 5, wherein the capacitive sensing element is further used for transmitting a sensing result of the environment capacitance to an RF signal processing device of the RF device, so as to adjust a power of the RF signal through the RF signal processing device.

7. The RF device of claim 5, wherein the coupling element of the antenna further comprises:

a horizontal side;

at least one vertical side, electrically connected to the horizontal side, for generating different coupling effects between the coupling element and the radiating element via switching one of the vertical side to connect with the grounding element.

8. The RF device of claim 5, wherein the switch connects and disconnects the coupling element of the antenna respectively generate a first coupling effect and a second coupling effect on the radiating element, wherein the first and the second current routes correspond to the first and the second frequency bands.

9. A radio-frequency (RF) device for a wireless communication device, comprising:

a grounding element, for providing grounding;

an antenna, comprising:

a radiating element, including a long side and a plurality of short sides, for transmitting an RF signal;

a coupling element, for coupling an RF signal;

a feed-in element, coupled to the coupling element, for transmitting the RF signal to the radiating element through the coupling element; and a switch, coupled between the plurality of short sides and the grounding element, for switching one of the plurality of short sides to connect with the grounding element, such that the antenna respectively operates in a first frequency band and a second frequency band; and a capacitive sensing element, electrically connected to the radiating element of the antenna, for sensing an environment capacitance within a specific range through the radiating element.

10. The RF device of claim 9, wherein the plurality of short sides of the antenna respectively generate a first current route and a second current route on the radiating element, wherein the first and the second current routes correspond to the first and the second frequency bands.

11. The RF device of claim 9, wherein the antenna further comprises a signal attenuator, coupled between the feed-in element and the coupling element, for attenuating the RF signal transmitted from the feed-in element.

12. The RF device of claim 9, wherein the capacitive sensing element is further used for transmitting a sensing result of the environment capacitance to an RF signal processing device of the RF device, so as to adjust a power of the RF signal through the RF signal processing device.

13. A wireless communication device, comprising:

a radio-frequency (RF) signal processing device, for generating an RF signal, adjusting a power of the RF signal according to a sensing result, and adjusting an operating frequency band according to the RF signal; and an RF device, comprising:

a grounding element, for providing grounding;

an antenna, comprising:

a coupling element, for coupling an RF signal;

a feed-in element, coupled to the coupling element, for transmitting the RF signal through the coupling element;

a radiating element, including a long side and a plurality of short sides, for transmitting the RF signal from the coupling element; and a switch, coupled between the plurality of short sides and the grounding element, for switching one of the plurality of short sides to connect with the grounding element, such that the antenna respectively operates in a first frequency band and a second frequency band;

a capacitive sensing element, electrically connected to the radiating element of the antenna, for sensing an environment capacitance within a specific range through the radiating element.

14. The RF device of claim 13, wherein the plurality of short sides of the antenna respectively generate a first current route and a second current route on the radiating element, wherein the first and the second current routes correspond to the first and the second frequency bands.

15. The RF device of claim 13, wherein the antenna further comprises a signal attenuator, coupled between the feed-in element and the coupling element, for attenuating the RF signal transmitted from the feed-in element.

16. The RF device of claim 13, wherein the capacitive sensing element is further used for transmitting a sensing result of the environment capacitance to an RF signal processing device of the RF device, so as to adjust a power of the RF signal through the RF signal processing device.

* * * * *